US006835145B2

(12) United States Patent
Tsurumaki

(10) Patent No.: US 6,835,145 B2
(45) **Date of Patent: *Dec. 28, 2004**

(54) GOLF CLUB

(75) Inventor: Masaei Tsurumaki, Tsubame (JP)

(73) Assignee: K.K. Endo Seisakusho, Niigata-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 10/273,972

(22) Filed: Oct. 17, 2002

(65) Prior Publication Data

US 2003/0083145 A1 May 1, 2003

(30) Foreign Application Priority Data

Oct. 23, 2001 (JP) ..... 2001-325523

(51) Int. Cl.[7] ..... A63B 53/04
(52) U.S. Cl. ..... 473/345
(58) Field of Search ..... 473/324, 342, 473/350, 332, 345, 346

(56) References Cited

U.S. PATENT DOCUMENTS

| | | | | | |
|---|---|---|---|---|---|
| 5,232,224 | A | * | 8/1993 | Zeider | 473/345 |
| 5,482,279 | A | * | 1/1996 | Antonious | 473/327 |
| 5,556,097 | A | * | 9/1996 | Endo et al. | 473/309 |
| 5,584,770 | A | * | 12/1996 | Jensen | 473/350 |
| 6,238,300 | B1 | * | 5/2001 | Igarashi | 473/324 |
| 2002/0091015 | A1 | * | 7/2002 | Seki | |

FOREIGN PATENT DOCUMENTS

| | | | |
|---|---|---|---|
| JP | 8010361 | | 1/1996 |
| JP | 2001-70487 | * | 3/2001 |

* cited by examiner

*Primary Examiner*—Stephen Blau
(74) *Attorney, Agent, or Firm*—Quarles & Brady LLP

(57) ABSTRACT

A golf club having a sufficiently high strength in a welded portion even if a material that should avoid heat treatment is used. A reinforcing plate 21 is provided in a portion where a face member 16 is welded to a sole 4 of a head 1. Even if Ti15-5-3 whose toughness is lowered due to changes in tissues caused by welding heat, sufficiently high strength can be obtained in the welded portion.

6 Claims, 2 Drawing Sheets

GOLF CLUB

BACKGROUND OF THE INVENTION

1. Field of the Invention

The present invention relates to a golf club with a shaft connected to one side of a head comprising a hollow body formed by combining a plurality of metallic shells.

2. Description of the Related Art

Heretofore, it is well recognized that a β type titanium alloy has been used as a raw material for a face portion of a golf club head. The β type titanium alloy is easy to process by cold plastic forming as compared with other titanium alloys, particularly suited for press molding something from plate raw materials. Further, the β type titanium alloy has an advantageous characteristic that sufficiently high strength can be obtained by subjecting the same to heat treatment.

In the β type titanium alloy, however, the heat treatment may have the opposite effect of reducing inherent properties of a raw material depending on the composition thereof. For example, whilst well-known Ti-15V-3Cr-3Sn-3Al (hereinafter referred to as Ti15-3-3-3) has its strength enhanced by heat treatment, Ti-15Mo-5Zr-3Al (hereinafter referred to as Ti15-5-3), although it also has its strength enhanced by heat treatment, has resultant decreased ductility or toughness so that it becomes apt to be cracked by repeated strikes by balls. Consequently, as Ti15-5-3 has such sufficiently high strength without heat treatment, it is usually used without heat treatment.

In the manufacturing process of golf club heads, heat treatment is typically performed after assembling a head by welding and then shaping it by grinding or the like. At the time of welding, the welding heat causes changes in the tissues of the materials in welded portions, causing non-uniformity in tissues between the welded portions of the head and the remaining portions thereof, which, however, can be made uniform by post heat treatment.

However, when using the aforesaid Ti15-5-3 or the like which preferably should avoid heat treatment from the point of view of strength, differences in tissues between portions affected by welding heat and those around them remain as they are. In this case, the welded portions are subjected to changes in the tissues by the welding heat, thus resulting in the decrease in toughness. As a result, there occurs a problem that the welded portions are apt to be cracked by the repeated strikes by balls.

SUMMARY OF THE INVENTION

To eliminate the above problems, it is, therefore, an object of the present invention to provide a golf club which has a sufficiently high strength in welded portions even if materials which should preferably avoid heat treatment are used.

A first aspect of the present invention is a golf club with a shaft connected to one side of a head comprising a hollow body formed by joining a plurality of metallic shells including a face member provided with a ball-striking portion on a front face thereof, in which a reinforcing plate is provided on a portion where the face member is joined to a sole portion of the head.

According to the construction of the first aspect, as the reinforcing plate is provided on the portion where the face member is joined to the sole portion of the head, even if a certain material whose tissues change due to the influence by the welding heat so that it decreases its toughness is used, sufficiently high strength can be insured on the welded portion between the face member and the sole portion of the head.

A second aspect of the present invention is a golf club according to the first aspect, in which the head is not heat-treated after the welding.

According to the construction of the second aspect, costs incurred by heat treatment can be eliminated due to no heat treatment being performed after welding, so that a golf club can be provided at low cost.

BRIEF DESCRIPTION OF THE DRAWING

For more complete understanding of the present invention, reference is now made to the following description taken in conjuncture with the accompanying drawings, in which.

DESCRIPTION OF THE PREFERRED EMBODIMENT

Figure 1:
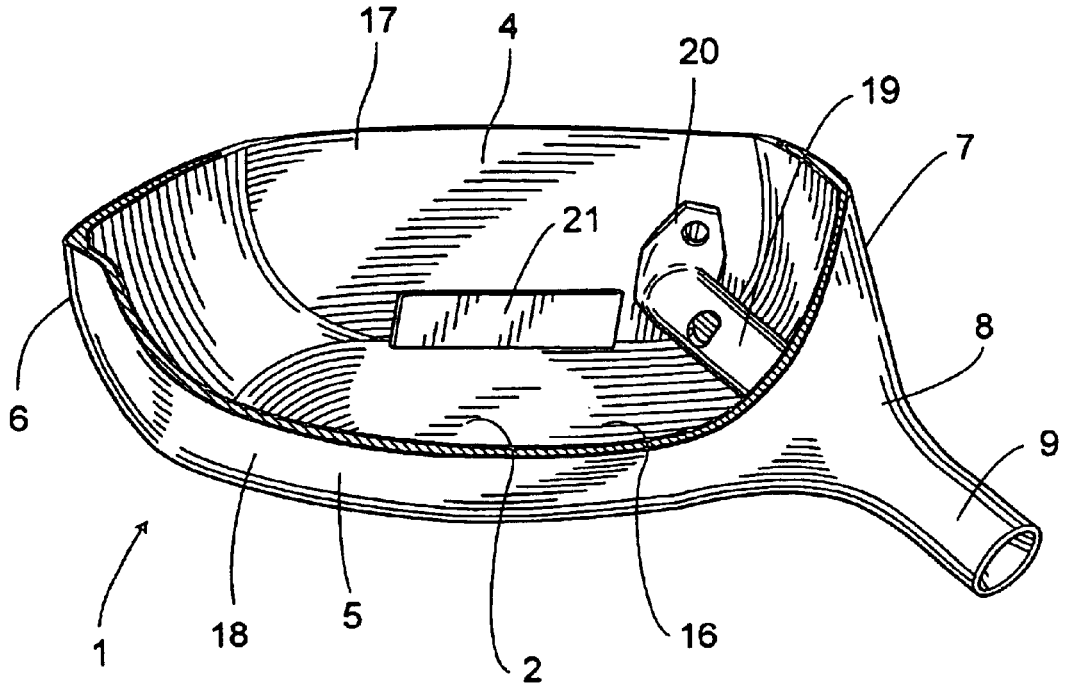
FIG. 1 is a partially cutaway perspective view of a head according to an embodiment of the present invention.
Figure 2:
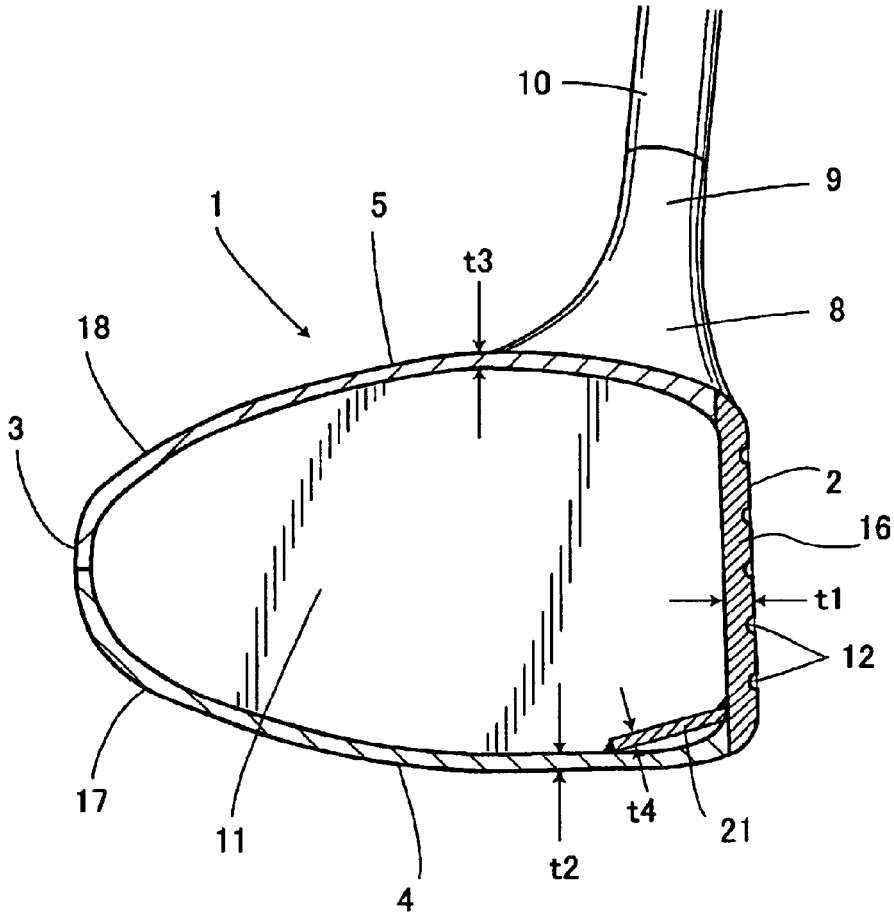
FIG. 2 is a longitudinal section of the above head.
Figure 3:
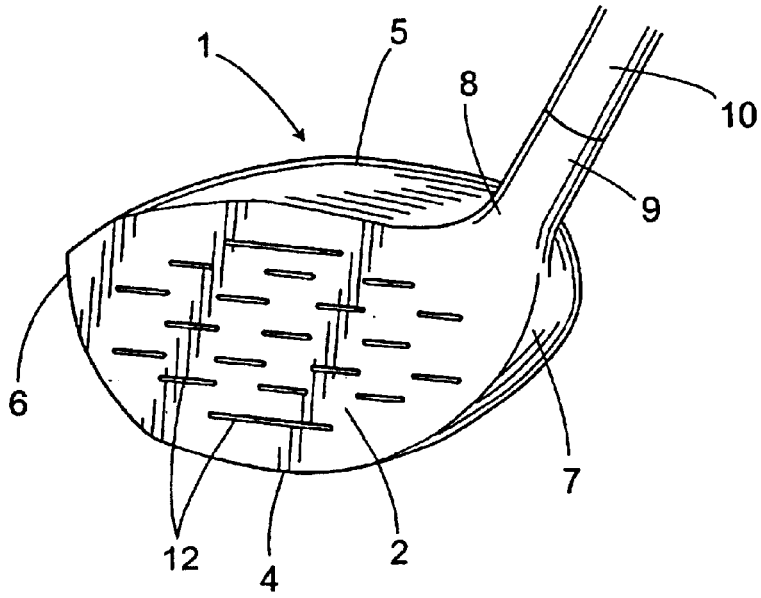
FIG. 3 is a perspective view showing the whole of the above head.

Hereunder is a description of an embodiment of the present invention with reference to the accompanying drawings, taking a wood golf club as an example. Numeral 1 denotes a metallic and hollow wood golf club, or so-called metal wood head. The head 1 includes a face 2 for striking balls on a front, a back 3 on a rear side, a sole 4 oil a bottom side, a crown 5 on a top side, a toe 6 on one side and a heel 7 on the other side in the lateral direction. The upper side of the heel 7 is formed with a neck 8, from which extends obliquely upward a hosel 9. The hosel 9 forms a juncture for connecting a shaft 10. Further, score lines 12 in the form of a plurality of grooves are formed on the face 2.

The head 1 is constructed by combining a plurality of metallic shells made of titanium or titanium alloy such as β type titanium alloy or the like, thus defining a hollow body denoted by a hollow portion 11 thereinside. In other words, the outer shell of the head 1 is made up of a face member 16, a body member 17 and a crown member 18 that are respectively plate-like metallic shells. The face member 16 forms mainly the face 2, the crown member 18 forms the crown 5, while the body member 17 forms the remaining portion such as a peripheral side portion including the back 3 and a bottom portion including the sole 4. The face member 16, the body member 17 and the crown member 18 are joined together by means of welding or the like. Incidentally, the aforesaid neck 8 and hosel 9 are formed from a metallic tubular hosel member 19.

Numeral 21 denotes a tabular reinforcing plate, which is welded to a portion where a lower portion of the face member 16 is joined to the sole 4 of the body member 17, thus spanning the face member 16 and the body member 17. Preferably, the reinforcing plate 21 is welded so that a welded area on the face member 16 may be as small as possible. If the welded area of the reinforcing plate 21 on the face member 16 is large, then the reinforcing plate 21 interferes with the face 2 to reduce the repulsive force of the face 2 against balls at the time of striking balls, and thus it is not desirable. In other word, whilst the repulsive force against balls is increased by the moderate bend of the face 2 at the time of striking balls, the face member 16 contacted by the reinforcing plate 21 with a large contact area is subject to restraints in bending the face 2, thus causing a hindrance to the development of a large repulsive force.

Further, numeral 20 denotes a reinforcing portion for securely welding the hosel member 19 to the sole 4, said reinforcing portion 20 being integrated with the hosel member 19. By providing the reinforcing portion 20, a welding area between the hosel member 19 and the sole 4 can be widened, enabling the secure and firm fixing of the hosel member 19.

Next is a description of the manufacturing method of the head 1.

In the first step, the face member 16, the body member 17 and the crown member 18, which are all metallic shells, are fabricated by press working plate materials made of titanium or titanium alloy such as β type titanium alloy or the like to form them into given shapes. At the same time, the tubular hosel member 19 and the reinforcing plate 21 are fabricated independently of the step. In the present embodiment, the face member 16 is formed from Ti-15V-3Cr-3Sn-3Al (Ti15-3-3-3) or Ti-15Mo-5Zr-3Al (Ti15-5-3), while the body member 17, the crown member 18, the hosel member 19 and the reinforcing plate 21 are formed from Ti15-3-3-3. Further, the thickness t2 of the body member 17 is set at 1.15 mm while the thickness t3 of the crown member 18 at 1.00 mm. For the reinforcing plate 21, it is set to have the thickness t4 of 1.00 mm, approximately sized at 8×45 mm.

Then, the face member 16 and the body member 17 are welded together and then the hosel member 19 made of a tubular material and the reinforcing plate 21 are in turn welded thereto, to which is further welded the crown member 18 to thereby form the hollow body which eventually becomes the head 1. Thereafter, the head 1 undergoes a grinding process, an adjusting process for adjusting lie and loft angles and then painting process to thereby obtain a final product. The head 1 thus finished is set to have a volume of 300 $cm^3$.

Three different types of golf clubs were prepared by changing only the material and thickness of the face member 16 in the aforesaid manufacturing process, which were then tested for the measurement of coefficient of restitution and endurance. In the test for coefficient of restitution, a head speed was set at 48.8 m/s, thus measuring an initial speed of a ball and a head speed at the time of striking, so that the respective coefficients of restitution were calculated by dividing the initial speed by the head speed. In the endurance test, a ball at a speed of 55 m/s was struck against the center of the face 2, so that the number of strikes by a ball was counted until a crack occurred on the face 2 for the first time.

For comparison purpose, conventional golf clubs without the reinforcing plate 21 were prepared and tested for each type. The results of the tests are as shown in Table 1. None of the heads 1 for the tests shown in Table 1 is heat-treated.

TABLE 1

| No. | The reinforcing plate 21 is provided? | Material of the face member 16 | Thickness t1 (mm) of the face member 16 | Coefficient of restitution | Endurance (the number of strikes by balls) |
|---|---|---|---|---|---|
| 1A | Yes | Til5-5-3 | 2.85 | 0.838 | 3,250–3,500 transverse cracks occurred in center face lines |
| 1B | No | Til5-5-3 | 2.85 | 0.842 | 2,750–2,850 transverse cracks occurred in center face lines |
| 2A | Yes | Til5-3-3-3 | 3.05 | 0.811 | 4,250–4,500 transverse cracks occurred in center face lines |
| 2B | No | Til5-3-3-3 | 3.05 | 0.815 | 3,500–3,750 transverse cracks occurred in center face lines |

As is apparent from the test results shown in Table 1, the coefficient of restitution dropped slightly by providing the reinforcing plate 21, but the drop rate thereof was as small as 0.003 to 0.004 that was within an error range. Accordingly, one can safely say that there were substantially no differences with regard to the coefficient of restitution between the golf clubs with the reinforcing plate 21 and the golf clubs without the same.

On the other hand, the endurance or durability was dramatically improved by providing the reinforcing plate 21 so that the number of strikes by balls counted until cracks occurred on the face 2 for the first time was increased by nearly 20%.

As is apparent from the foregoing, a golf club according to the foregoing embodiment of the invention is a golf club with the shaft 10 connected to one side of the head 1, said head 1 comprising the hollow body formed by joining a plurality of metallic shells including the face member 16 with the ball-striking face 2 on a front thereof, the body member 17 and the crown member 18 by means of welding, wherein the reinforcing plate 21 is provided on a juncture where the face member 16 is joined to the sole 4 of the head 1.

Accordingly, as the reinforcing plate 21 is provided on a portion where the face member 16 is joined to the sole 4 of the head 1, sufficiently high strength can be insured in a portion where the face member 16 is welded to the sole 4 of the head 1 even if the aforesaid Ti15-5-3 or the like is used, said Ti15-5-3 being so susceptible to welding heat that the toughness thereof is apt to be lowered due to the changes in tissues caused by the thermal influence by the welding heat. Further, even if a material which has slightly inferior strength but is inexpensive is used, it is possible to manufacture a golf club with high strength head 1 at lower costs than by the prior art as such high strength head 1 can be manufactured by providing the reinforcing plate 21.

Moreover, as the above head 1 is not heat-treated after welding, a golf club can be provided at low costs as the costs incurred by heat treatment are eliminated to no post-welding heat treatment being performed.

Incidentally, the present invention should not be limited to the foregoing embodiment but various modifications are possible within the scope of the invention. For example, although the head 1 is constructed by three pieces such as the face member 16, the body member 17 and the crown member 18 in the present embodiment, it may be constructed by two pieces consisting of the face member 16 and the other member, or four or more pieces consisting of the face member 16 and the other three or more members. Further, although post-welding heat treatment is not performed in the foregoing embodiment, it may be done if necessary. When heat treatment is performed, it may desirably be done after undergoing grinding process and adjusting process for adjusting loft and lie angles. Alternatively, the present invention may be applied to a hollow type iron golf club as well.

What is claimed is:

1. A golf club with a shaft connected to one side of a head, said head comprising a hollow body formed by joining a plurality of metallic shells by welding, said plurality of metallic shells including a face member provided with a ball-striking portion on a front face thereof, wherein:

a reinforcing plate is provided on a portion where said face member is welded to a sole portion of said head in a manner that spans said face member and sole portion and wherein said reinforcing plate is tabular and is attached with its plane surface facing a sole face, one end of said reinforcing plate abutting against said face member to be welded thereto, while an opposite end of said reinforcing plate abutting against said sole face to be welded so that said plane surface of the reinforcing plate abuts against neither said face member nor said sole portion.

2. A golf club according to claim 1, wherein said face member is formed from Ti-15V-3Cr-3Sn-3Al.

3. A golf club according to claim 1, wherein said face member is formed from Ti-15Mo-5Zr-3Al.

4. A golf club according to claim 1, further comprising a hosel member for connecting a shaft thereto and a reinforcing portion, said reinforcing portion being provided on a distal portion of said hosel member which is joined to the sole portion of said head.

5. A golf club according to claim 1, wherein said plurality of metallic shells are a face shell, a body shell and a crown shell.

6. A golf club according to claim 1, wherein said head is not heat-treated after welding.

* * * * *